United States Patent [19]

Haga et al.

[11] Patent Number: 5,029,840

[45] Date of Patent: Jul. 9, 1991

[54] AUTOMATIC SHEET FEEDER FOR AN IMAGE RECORDING APPARATUS

[75] Inventors: Hiroyoshi Haga, Kawaguchi; Tatsuhiko Oikawa, Kitakami, both of Japan

[73] Assignee: Ricoh Company, Ltd., Tokyo, Japan

[21] Appl. No.: 397,191

[22] Filed: Aug. 23, 1989

[30] Foreign Application Priority Data

Aug. 30, 1988 [JP] Japan ..... 63-215505
May 25, 1989 [JP] Japan ..... 1-131778

[51] Int. Cl.[5] ..... B65H 3/52; B65H 3/06

[52] U.S. Cl. ..... 271/122; 271/109

[58] Field of Search ..... 271/109, 119, 120, 121, 271/122, 125, 272–274

[56] References Cited

U.S. PATENT DOCUMENTS

| | | | |
|---|---|---|---|
| 2,887,316 | 5/1959 | Tobey | 271/125 |
| 4,232,860 | 11/1980 | Brown | 271/119 |
| 4,496,145 | 1/1985 | Fukui | 271/122 |
| 4,515,358 | 5/1985 | Fukui | 271/122 |
| 4,678,178 | 7/1987 | Akiyama et al. | 271/273 |
| 4,715,597 | 12/1987 | Sakurai | 271/122 |
| 4,728,095 | 3/1988 | Irvine et al. | 271/124 |
| 4,763,575 | 8/1988 | Miciukiewicz | 271/274 |
| 4,801,134 | 1/1989 | Yokoyama et al. | 271/125 |

FOREIGN PATENT DOCUMENTS

| | | | |
|---|---|---|---|
| 185745 | 8/1988 | Japan | 271/122 |
| 267228 | 10/1989 | Japan | 271/109 |

*Primary Examiner*—Robert P. Olszewski
*Assistant Examiner*—Steve Reiss
*Attorney, Agent, or Firm*—Oblon, Spivak, McClelland, Maier & Neustadt

[57] ABSTRACT

An automatic sheet feeder for feeding paper sheets one by one toward a body of an image recording apparatus has a feed roller and lap feed preventing device for preventing two or more paper sheets from being fed together. The lap feed preventing device is implemented as a reverse roller which is pressed against the feed roller and provided with a circumferential recess in a predetermined position thereof. When paper sheets each being formed with three holes for filing at spaced locations along the width thereof are used with the sheet feeder, the circumferential recess of the reverse roller coincides with the intermediate hole of each paper sheet being fed.

7 Claims, 4 Drawing Sheets

AUTOMATIC SHEET FEEDER FOR AN IMAGE RECORDING APPARATUS

BACKGROUND OF THE INVENTION

The present invention relates to a printer, facsimile machine, copier or similar image recording apparatus which records an image on a paper sheet. More particularly, the present invention is concerned with an automatic sheet feeder for use with such an image recording apparatus for feeding paper sheets one by one to a body of the apparatus.

A predominant type of automatic sheet feeder has a feed roller and a reverse roller or a friction pad which prevents two or more paper sheets from being fed together, i.e., lap feed in association with the feed roller. The feed roller is located at the intermediate between widthwise opposite ends of a sheet transport path to which a paper sheet is driven by a pull-out roller from a sheet cassette, for example. On the other hand, many of modern printers or similar image recording apparatuses the type having such an automatic sheet feeder are operated with paper sheets which are formed with holes for filing purpose. For example, concerning a paper sheet having three filing holes, at least one of the holes is positioned at the intermediate between widthwise opposite ends of the paper sheet. When paper sheets of this kind are fed from a sheet cassette by the above-described type of automatic sheet feeder, the reverse roller which plays the role of lap feed feed preventing means and the intermediate hole of the paper sheet coincide resulting in lap feed.

SUMMARY OF THE INVENTION

It is therefore an object of the present invention to provide an automatic sheet feeder for an image recording apparatus which eliminates the lap feed of paper sheets.

It is another object of the present invention to provide an automatic sheet feeder for an image recording apparatus which is free from lap feed even when use is made of paper sheets each having one hole at the intermediate between opposite widthwise ends thereof.

It is another object of the present invention to provide a generally improved automatic sheet feeder for an image recording apparatus.

An automatic sheet feeder for feeding a number of paper sheets one by one of the present invention comprises a rotatable drive roller for driving the paper sheets sequentially and lap feed preventing means facing and held in contact with the drive roller for preventing two or more of the paper sheets from being fed at the same time. At least one of the drive roller means and the lap feed preventing means comprising a circumferential recess formed in a predetermined position of at least one of the drive roller means and the lap feed preventing means for preventing the contact of the drive roller means and the lap feed preventing means at the predetermined position.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

To better understand the present invention, a brief reference will be made to a prior art automatic sheet feeder, shown in FIG. 1. As shown, the prior art automatic feeder, generally 10, has a feed roller 12 and a reverse roller 14 which is pressed against the feed roller 12 and provided with lap feed preventing means in the form of a torque limiter.

Figure 1:
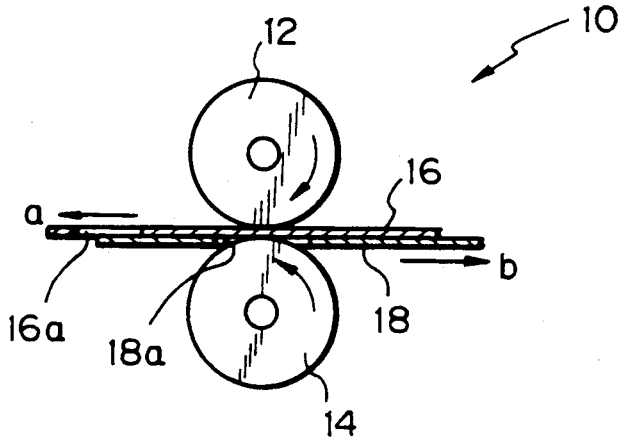
Fig. 1 PRIOR ART
FIG. 1 is a view showing the construction and operation of a prior art automatic sheet feeder.

As shown in FIG. 1, assume that two paper sheets, i.e., the first paper sheet 16 which should be fed and the second paper sheet 18 which should not be fed are driven together out of a sheet cassette (not shown), for example, to between the feed roller 12 and the reverse roller 14, and that a hole 18*a* formed in the second paper sheet 18 has coincided with the rollers 12 and 14. Then, the reverse roller 14 makes contact with the first paper sheet 16 through the hole 18*a* of the second paper sheet 18, resulting in the rotation of the feed roller 12 being transmitted to the reverse roller 14 through the first paper sheet 16. As a result, the reverse roller 14 is caused to rotate counterclockwise as viewed in the figure by overcoming the torque of the torque limiter which will be described, feeding the second paper sheet 18 together with the first paper sheet 16 as indicated by an arrow a. As soon as the hole 18*a* of the second paper sheet 18 moves away from the feed roller 12 and reverse roller 14, the paper sheets 16 and 18 slip on each other due to their small coefficient of friction to thereby prevent the rotation of the feed roller 12 from being sufficiently transferred to the reverse roller 14. When the torque becomes smaller than the torque of the torque limiter, the reverse roller 14 begins to rotate clockwise as viewed in the figure and, therefore, urges the second paper sheet 18 backward as indicated by an arrow b. Then, the hole 18*a* of the second paper sheet 18 is again brought into coincidence with the feed roller 12 and reverse roller 14, so that the rotation of the feed roller 12 is transmitted to the reverse roller 14 through the first paper sheet 16. This causes the reverse roller 14 to rotate counterclockwise to drive the second paper sheet 18 in the direction a, as stated earlier. As the hole 18*a* moves away from the rollers 12 and 14, the roller 14 again returns the second paper sheet 18 in the direction b. Such an occurrence makes it difficult for the second paper sheet 18 to be returned toward the sheet cassette and even allows the second paper sheet 18 to be fed together with the first paper sheet 16.

While the above description has concentrated on a condition wherein the hole 18*a* of the second paper sheet 18 coincides with the feed roller 12 and reverse roller 14, the same holds true with a case wherein a hole 16*a* of the first paper sheet 16 coincides with the rollers 12 and 14 and a case wherein both of the holes 16*a* and 18*a* coincide with the rollers 12 and 14.

The previously mentioned torque limiter associated with the reverse roller 14 serves to reverse the rotation of the reverse roller 14 when the torque acting on the roller 14 is smaller than a predetermined value. Assume that a single paper sheet, e.g., the first paper sheet 16 has been fed to between the feed roller 12 and reverse roller 14. Then, the rotation of the feed roller 12 is transmitted to the reverse roller 14 through the paper sheet 16 with the result that the roller 14 is driven counterclockwise by the roller 12, as shown in FIG. 1. On the other hand, when two or more paper sheets such as the first and second paper sheets 16 and 18 are fed together, they slip on each other due to their small coefficient of friction. Hence, the rotation of the feed roller 12 is hardly transmitted to the reverse roller 14 so that the torque limiter is activated to reverse the rotation of the roller 14.

Figure 2:
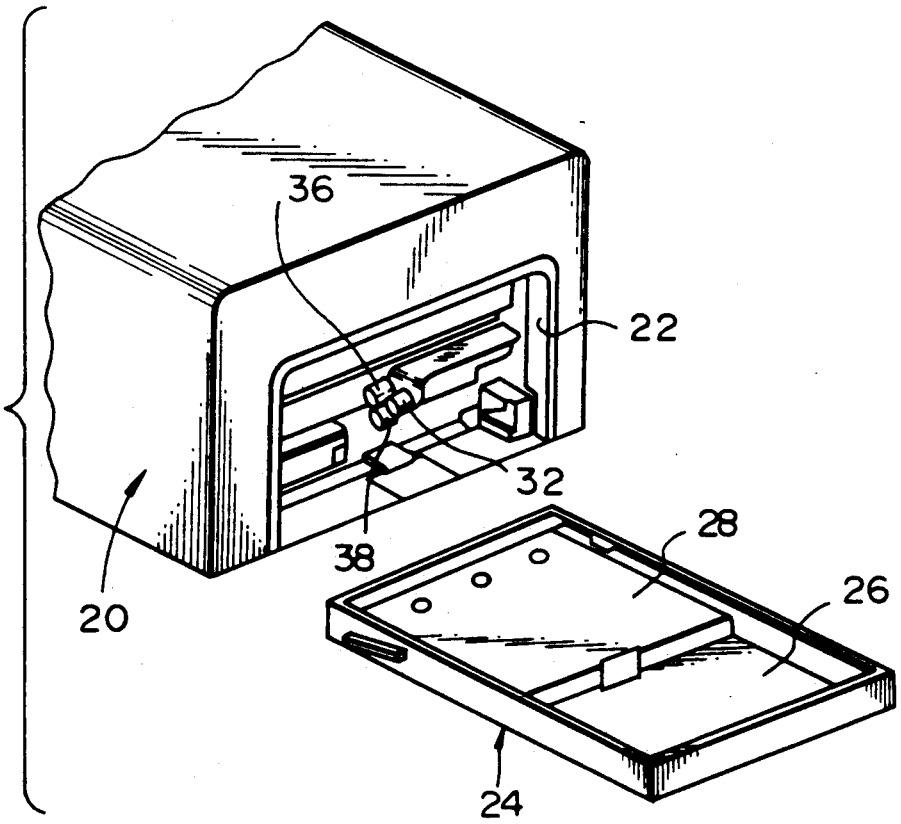
FIG. 2 is a perspective view of a printer to which the present invention is applied.
Figure 3:
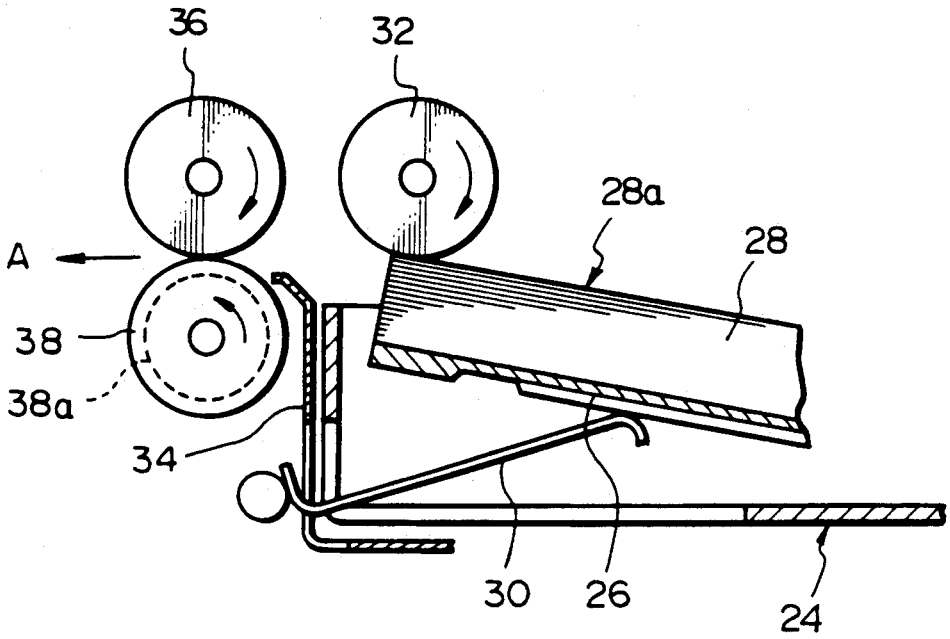
FIG. 3 is a section of an automatic sheet feeder embodying the present invention.

Referring to FIG. 2, a printer to which the present invention is applied is shown and generally designated by the reference numeral 20. The printer 20 has an opening 22 in which a sheet cassette 24 is removably mounted. The sheet cassette 24 has a bottom plate 26 which is loaded with a stack of paper sheets 28. As shown in FIG. 3, a lever 30 is operated to raise the bottom plate 26 until the leading edge of the uppermost paper sheet 28*a* presses itself against a pull-out roller 32. In response to a feed command, the pull-out roller 32 rotates clockwise as viewed in FIG. 2 so as to drive the paper sheet 28*a* out of the cassette 24. Then, the paper sheet 28*a* is guided by a guide member 34 to reach a feed roller 36 and a reverse roller 38 which is pressed against the feed roller 36 and provided with a torque limiter. As FIG. 2 indicates, the pull-out roller 32, feed roller 36 and reverse roller 38 are accommodated in the printer 20 and located at the intermediate between widthwise opposite ends of a sheet transport path. As a predetermined period of time expires after the arrival of the paper sheet 28*a* at the feed roller 36 and reverse roller 38, a solenoid (not shown) is energized to raise the pull-out roller 32 away from the paper sheet 28*a*. Subsequently, the feed roller 36 is rotated counterclockwise to transport the paper sheet 28*a* as indicated by an arrow A in FIG. 3.

Figure 4:
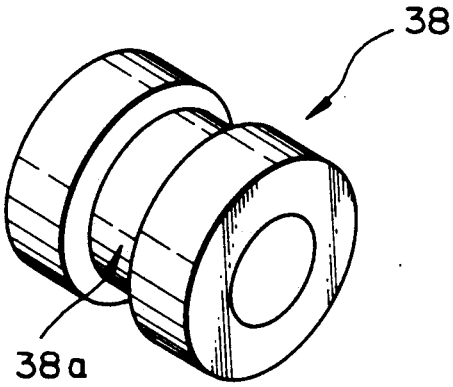
FIG. 4 is a perspective view of a reverse roller included in the automatic sheet feeder shown in FIG. 3.
Figure 5A:
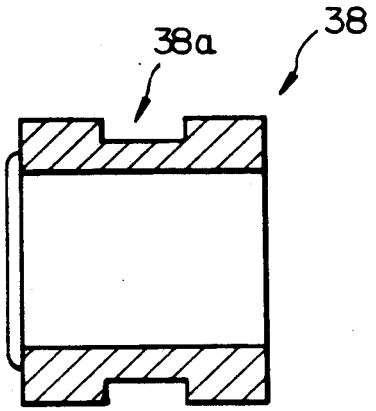
FIGS. 5A to 5D are sections showing specific configurations of the reverse roller applicable to the automatic sheet feeder of the present invention.
Figure 5B:
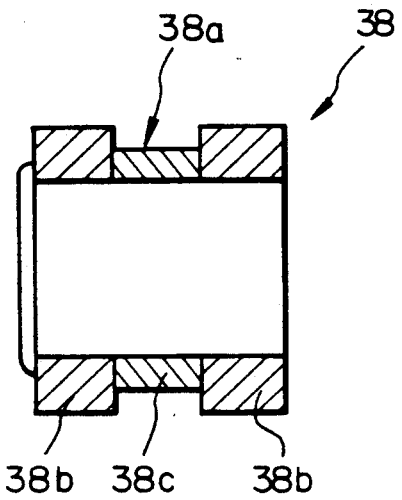
Figure 5C:
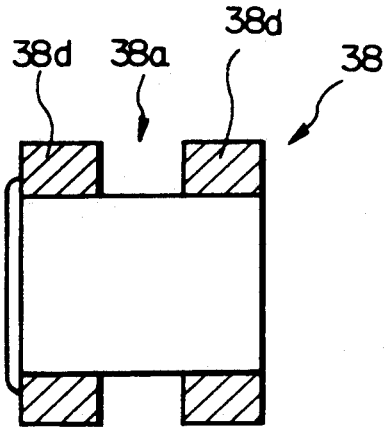
Figure 5D:
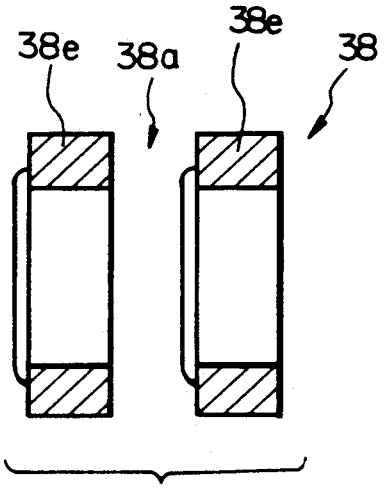
Figure 6:
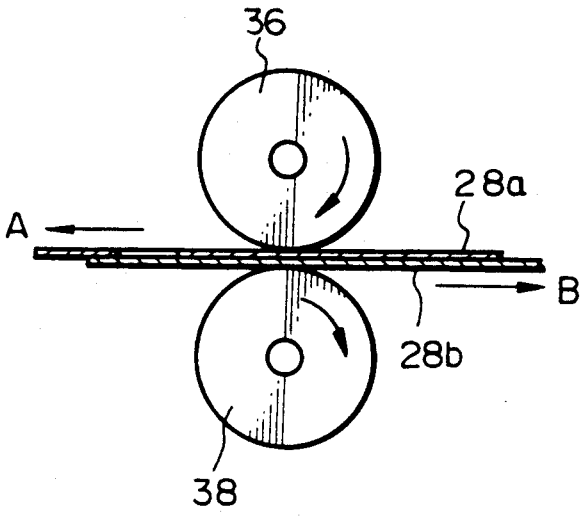
FIG. 6 is a view showing how the automatic document feeder shown in FIG. 3 eliminates lap feed.

As shown in FIG. 4, the reverse roller 38 is generally cylindrical and provided with a non-contact portion 38*a* at the intermediate between opposite ends thereof. The non-contact portion 38*a* is implemented as a circumferential recess, as illustrated. Some specific configurations of the reverse roller 38 are shown in FIGS. 5A to 5D. In FIG. 5A, the reverse roller 38 is implemented as a single molding. In FIG. 5B, the reverse roller 38 is constituted by two portions 38*b* having a larger diameter and one portion 38*c* having a smaller diameter and intervening between the two portions 38*b*. In FIG. 5C, the reverse roller 38 has two portions 38*d* which have the same diameter and are spaced apart from each other. Further, in FIG. 5D, the reverse roller 38 is made up of two independent roller parts 38*e* having an identical configuration.

Although not shown in the drawings, the reverse roller 38 is also provided with a torque limiter for reversing the rotation of the roller 38 when the torque acting on the roller 38 is smaller than a predetermined value. For example, when only a single paper sheet 28*a* is fed from the sheet cassette 22 to the feed roller 36 and reverse roller 38 by the pull-out roller 32, the rotation of the feed roller 36 is transmitted to the reverse roller 38 through the paper sheet 28*a* with the result that the roller 38 is driven counterclockwise by the roller 36 as viewed in FIG. 3. On the other hand, when two or more paper sheets such as the first and second paper sheets 28*a* and 28*b* are fed together, they slip on each other due to their small coefficient of friction. Hence, the rotation of the feed roller 36 is little transmitted to the reverse roller 38 so that the torque limiter is activated to reverse the rotation of the roller 38. More specifically, assume that the pull-out roller 32 has driven not only the expected uppermost paper sheet 28*a* but also a paper sheet 28*b* underlying the paper sheet 28*a* toward the the feed roller 36 and reverse roller 38. Then, the uppermost paper sheet 28*a* is transported in the direction A because the rotation of the feed roller 36 acts on the paper sheet 28*a* directly. On the other hand, the second or underlying paper sheet 28*b* is returned toward the sheet cassette 22 by the reverse roller 38 which is rotating in the opposite direction.

Figure 7:
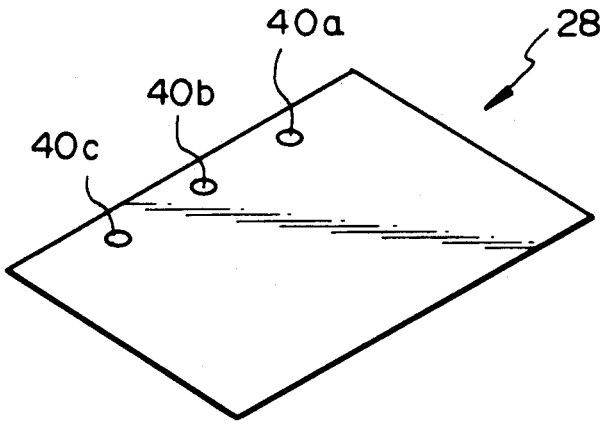
FIG. 7 is a perspective view of a paper sheet with holes which is applicable to the automatic sheet feeder shown in FIG. 3.

As shown in FIG. 7, assume that the automatic document feeder of the illustrative embodiment is operated with a paper sheet 28 which is formed with three holes 40*a*, 40*b* and 40*c* for filing purposes. When such a paper sheet or paper sheets 28 are fed from the sheet cassette 22 to the feed roller 36 and reverse roller 38 by the pull-out roller 32, it may occur that the intermediate hole 40*b* of any of the paper sheets 28 coincides with the reverse roller 38. In the illustrative embodiment, the reverse roller 38 is provided with the circumferential recess or non-contact portion 38*a* which corresponds in position to the hole 40*b*. Hence, the feed roller 36 and reverse roller 38 hold the paper sheet 28 just in the same manner as they hold a paper sheet without a hole. It follows that the second paper sheet 28*b* having three holes 40*a*, 40*b* and 40*c* as shown in FIG. 7 is prevented from being transported together with the uppermost paper sheet 28*a* in the direction A, i.e., it is returned toward the sheet cassette 22. This will be especially advantageous when paper sheets 28 are fed at short intervals to promote high-speed printing.

Advantageously, the circumferential recess or non-contact portion 38*a* of the reverse roller 38 is provided with a width which is the same as or greater than the width of the hole 40*b* of the paper sheet 28. Considering the wear of the reverse roller 38, it is preferable that the roller 38 has an outside diameter greater than that of the feed roller 36 and has a substantial hardness.

While the lap feed preventing means has been shown and described as being implemented as the reverse roller 38, it may alternatively be implemented as a friction pad. If desired, the non-contact portion in the form of the circumferential recess 38*a* may be formed in the feed roller 36 or in both of the feed roller 36 and reverse roller 38. When the reverse roller 38 is replaced with a friction pad, for example, such a non-contact portion may of course be formed in the friction pad.

In summary, in accordance with the present invention, at least one of lap feed preventing means in the form of a reverse roller or a friction pad and a feed roller has a non-contact portion in order to remain clear of a hole which is formed at the intermediate between opposite widthwise ends of a paper sheet for filing purpose. The feed roller and lap feed preventing means, therefore, hold a paper sheet with such a hole just in the same manner as they hold a paper sheet without a hole. Hence, when the automatic document feeder of the illustrative embodiment is operated with paper sheets with holes, it surely prevents the lap feed of two or more papers even though the intermediate hole may coincide with the lap feed preventing means.

Various modifications will become possible for those skilled in the art after receiving the teachings of the present disclosure without departing from the scope thereof.

What is claimed is:

1. An automatic sheet feeder for feeding a number of paper sheets one by one, comprising:

rotatable drive roller means for driving the paper sheets sequentially; and lap feed preventing means facing and held in contact with said drive roller means for preventing two or more of the paper sheets from being fed at the same time;

said lap feed preventing means comprising generally cylindrical reverse roller means which is driven by said drive roller means in a reversible rotary motion;

at least one of said drive roller means and said lap feed preventing means comprising a circumferential recess formed in a predetermined position of at least one of said drive roller means and said lap feed preventing means for preventing the contact of said drive roller means and said lap feed preventing means at said predetermined position;

the predetermined position of said at least one drive roller means and lap feed preventing means formed with said circumferential recess corresponding to a position of one of a plurality of holes which are formed through the paper sheet being transported for filing purposes.

2. An automatic sheet feeder as claimed in claim 1, wherein the one hole of the paper sheet is located at the intermediate between widthwise opposite ends of the paper sheet.

3. An automatic sheet feeder as claimed in claim 2, wherein said circumferential recess has a width equal to or greater than a diameter of the hole.

4. An automatic sheet feeder as claimed in claim 1, wherein said reverse roller means has an outside diameter greater than an outside diameter of said drive roller means.

5. An automatic sheet feeder as claimed in claim 1, wherein said reverse roller means has a hardness greater than a hardness of said drive roller mans.

6. An automatic sheet feeder as claimed in claim 1, wherein said reverse roller means comprises an integral molding.

7. An automatic sheet feeder as claimed in claim 1, wherein said reverse roller means comprises roller portions and a circumferential recess portion which are assembled together.

* * * * *